US005230444A

United States Patent [19]

Dunbar

[11] Patent Number: 5,230,444

[45] Date of Patent: Jul. 27, 1993

[54] TOOTHPASTE DISPENSER APPARATUS

[76] Inventor: William J. Dunbar, 1126 Ives Ave. North, Glencoe, Minn. 55336

[21] Appl. No.: 808,234

[22] Filed: Dec. 16, 1991

[51] Int. Cl.[5] ..... B67D 5/06

[52] U.S. Cl. ..... 222/181; 222/192; 222/386; 222/527; 222/93

[58] Field of Search ..... 222/93–104, 222/192, 181, 386, 527; D6/541, 524

[56] References Cited

U.S. PATENT DOCUMENTS

| | | | |
|---|---|---|---|
| 971,818 | 10/1910 | Barker | 222/100 X |
| 2,111,181 | 3/1938 | Findley | 222/93 |
| 2,517,321 | 8/1950 | Jordan | 222/100 |
| 2,748,981 | 6/1956 | Bean | 222/97 |
| 2,845,202 | 7/1958 | Downey | 222/97 |
| 3,173,578 | 3/1965 | Williams | 222/100 X |
| 3,204,823 | 9/1965 | Watson, Jr. | 222/93 |
| 3,987,932 | 10/1976 | Maldon | 222/93 X |
| 4,450,982 | 5/1984 | Ferreira | 222/93 |
| 4,874,113 | 10/1989 | Schmidt | 222/181 X |

*Primary Examiner*—Andres Kashnikow
*Assistant Examiner*—Keith DeRosa
*Attorney, Agent, or Firm*—Leon Gilden

[57] ABSTRACT

A support plate includes a cup-receiving bore directed therethrough, with a row of toothbrush bores directed through opposed sides of the cup-receiving bore. A first arcuate flange coaxially aligned relative to the cup-receiving bore projects orthogonally downwardly relative to the support plate terminating in a cup-receiving flange floor to position a cup therewithin. A rear flange is mounted rearwardly of the cup-receiving flange permitting attachment to a vertical wall surface. A toothpaste receiving magazine tube is mounted to the support plate about a rear edge thereof to receive a pressurized toothpaste magazine supplied therewithin. A modification of the invention includes a housing to receive the pressurized toothpaste container, as well as a mouthwash dispensing reservoir utilizing a pump member operative through a flexible hose to direct a mouthwash solution to an individual.

2 Claims, 4 Drawing Sheets

TOOTHPASTE DISPENSER APPARATUS

BACKGROUND OF THE INVENTION

1. Field of the Invention

The field of invention relates to toothpaste dispensing apparatus, and more particularly pertains to a new and improved toothpaste dispenser apparatus wherein the same is arranged to accommodate various components in an oral hygiene procedure including application of a toothpaste to an associated toothbrush.

2. Description of the Prior Art

Various toothbrush and toothpaste dispenser structure has been available in the prior art for the positioning and mounting of a toothpaste tube relative to assorted structure such as in U.S. Pat. No. 3,586,212 to Tzouras providing for a toothpaste cap arranged for positioning a toothbrush relative to the cap in a dispensing of toothpaste relative to the toothbrush.

U.S. Pat. No. 4,396,238 to Torruella sets forth a toothbrush holder utilizing a box fastener structure to surroundingly enclose a toothbrush head therewithin.

U.S. Pat. No. 4,325,485 to Pina, et al. sets forth a rack member arranged to hold an array of toothbrushes thereto.

As such, it may be appreciated that there continues to be a need for a new and improved toothpaste dispenser apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of toothpaste dispenser apparatus now present in the prior art, the present invention provides a toothpaste dispenser apparatus wherein the same is arranged to mount a toothpaste magazine container relative to a holder for an array of toothbrush members. As such, the general purpose of the present invention, which will be described subsequently in greater detail, is to provide a new and improved toothpaste dispenser apparatus which has all the advantages of the prior art toothpaste dispenser apparatus and none of the disadvantages.

To attain this, the present invention provides a support plate including a cup-receiving bore directed therethrough, with a row of toothpaste bores directed through opposed sides of the cup-receiving bore. A first arcuate flange coaxially aligned relative to the cup-receiving bore projects orthogonally downwardly relative to the support plate terminating in a cup-receiving flange floor to position a cup therewithin. A rear flange is mounted rearwardly of the cup-receiving flange permitting attachment to a vertical wall surface. A toothpaste receiving magazine tube is mounted to the support plate about a rear edge thereof to receive a pressurized toothpaste magazine supplied therewithin. A modification of the invention includes a housing to receive the pressurized toothpaste container, as well as a mouthwash dispensing reservoir utilizing a pump member operative through a flexible hose to direct a mouthwash solution to an individual.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toothpaste dispenser apparatus which has all the advantages of the prior art toothpaste dispenser apparatus and none of the disadvantages.

It is another object of the present invention to provide a new and improved toothpaste dispenser apparatus which may be easily and efficiently manufactured and marketed.

It is a further object of the present invention to provide a new and improved toothpaste dispenser apparatus which is of a durable and reliable construction.

An even further object of the present invention is to provide a new and improved toothpaste dispenser apparatus which is susceptible of a low cost of manufacture with regard to both materials and labor, and which accordingly is then susceptible of low prices of sale to the consuming public, thereby making such toothpaste dispenser apparatus economically available to the buying public.

Still yet another object of the present invention is to provide a new and improved toothpaste dispenser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
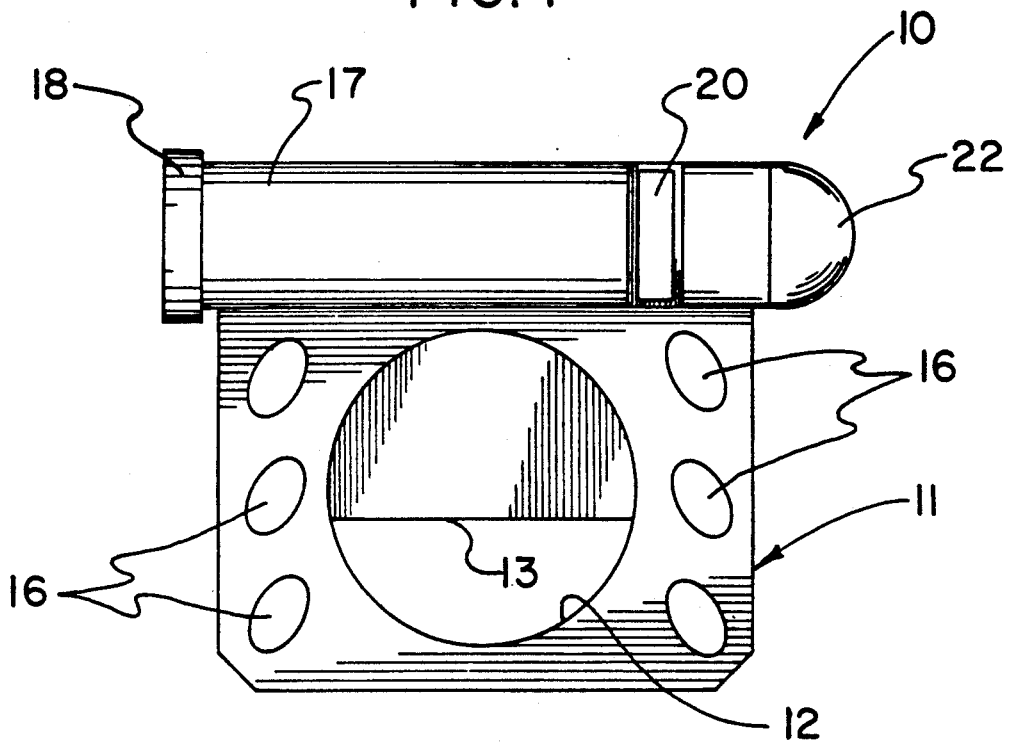
FIG. 1 is a top orthographic view of the instant invention.
Figure 2:
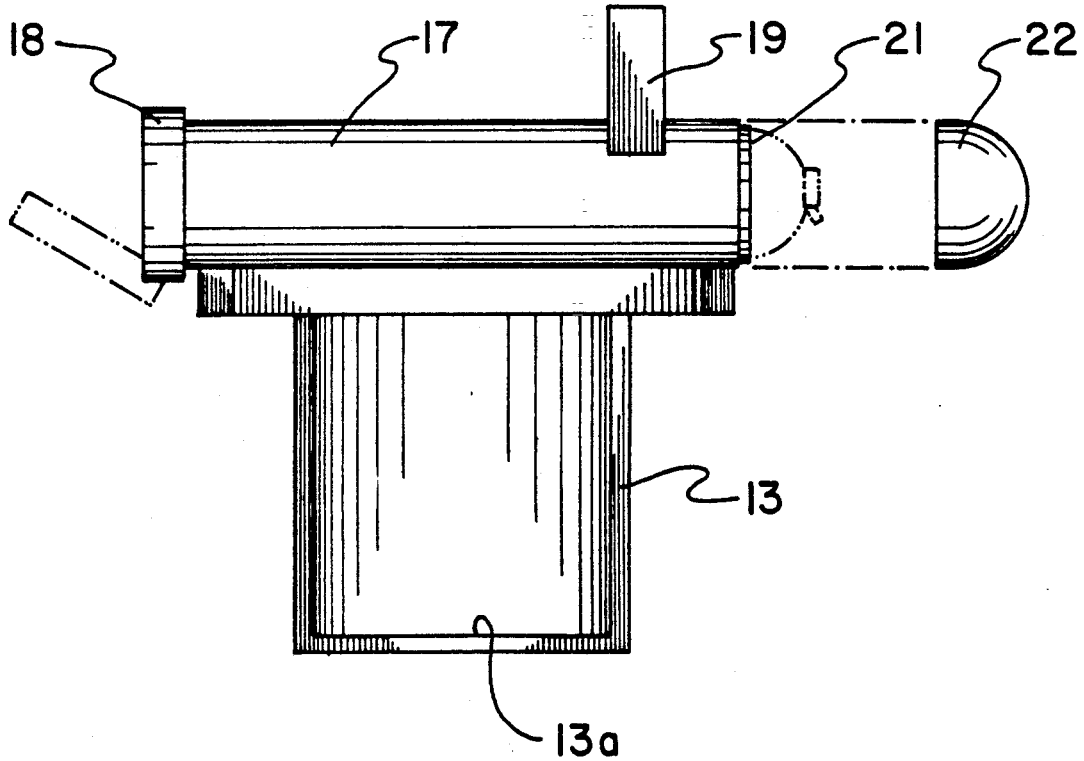
FIG. 2 is a frontal orthographic view, taken in elevation, of the invention.
Figure 3:
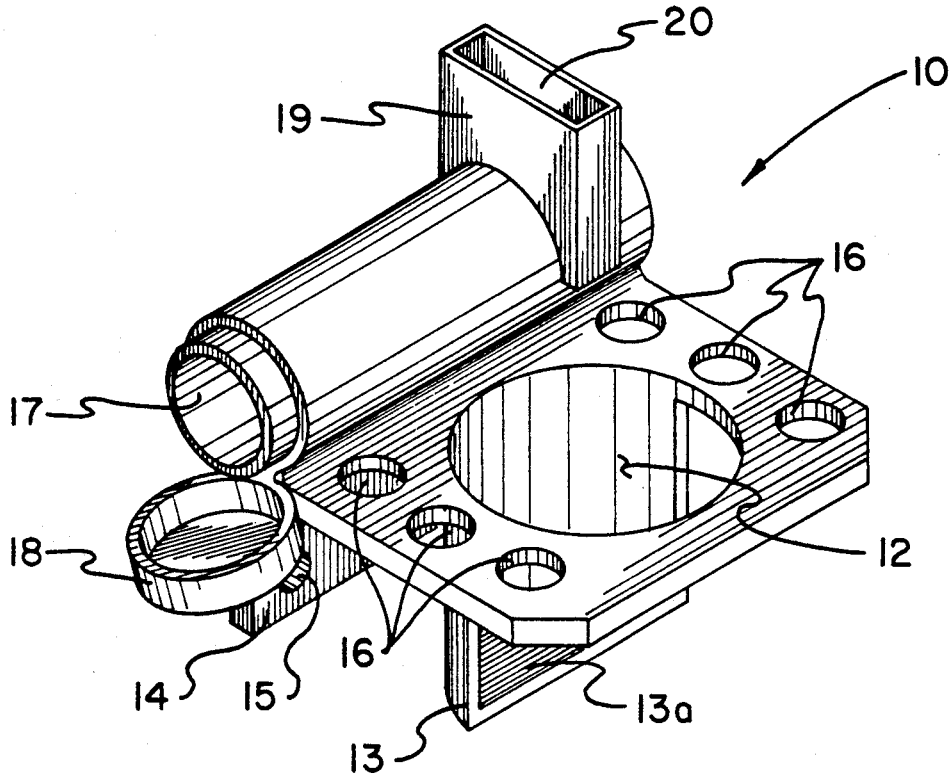
FIG. 3 is an isometric illustration of the instant invention.
Figure 4:
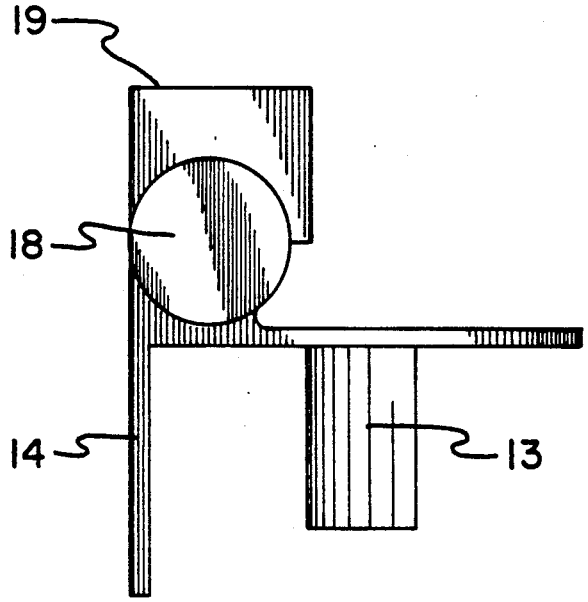
FIG. 4 is an orthographic side view of the instant invention.

With reference now to the drawings, and in particular to FIGS. 1 to 7 thereof, a new and improved toothpaste dispenser apparatus embodying the principles and concepts of the present invention and generally designated by the reference numerals 10 and 10*a* will be described.

More specifically, the toothpaste dispenser apparatus 10 of the instant invention essentially comprises a support plate 11, including a cup-receiving bore 12 directed through the plate substantially medially thereof. A semi-cylindrical flange 13 concentrically mounted relative to the bore 12 extends orthogonally downwardly relative to the support plate 11 terminating in a floor 13*a* that is oriented parallel relative to the support plate 11 to provide abutment for a cup directed through the bore. A rear flange plate 14 is orthogonally mounted downwardly relative to a rear edge of the support plate 11, and includes mounting bores 15 directed therethrough permitting mounting of the apparatus relative to a vertical wall surface. A plurality of rows of toothbrush bores 16 are mounted on diametrically opposed sides of the bore 12 adjacent the sides of the plate 11. A cylindrical magazine tube 17 is fixedly mounted adjacent a rear edge of the support plate and wherein the cylindrical magazine tube 17 defines an axis oriented parallel relative to the support plate 11. The magazine tube 17 includes a rear end cap 18 arranged for reception of a pressurized toothpaste tube 21 therewithin, wherein the toothpaste tube 21 includes a cap 22 mounted to a forward end of the toothpaste tube or container 21. A dental floss receiving mount 19 is fixedly mounted to the magazine tube 17 projecting upwardly thereof defining a receiving mount cavity 20 to receive a container of dental floss (not shown) therewithin.

Figure 5:
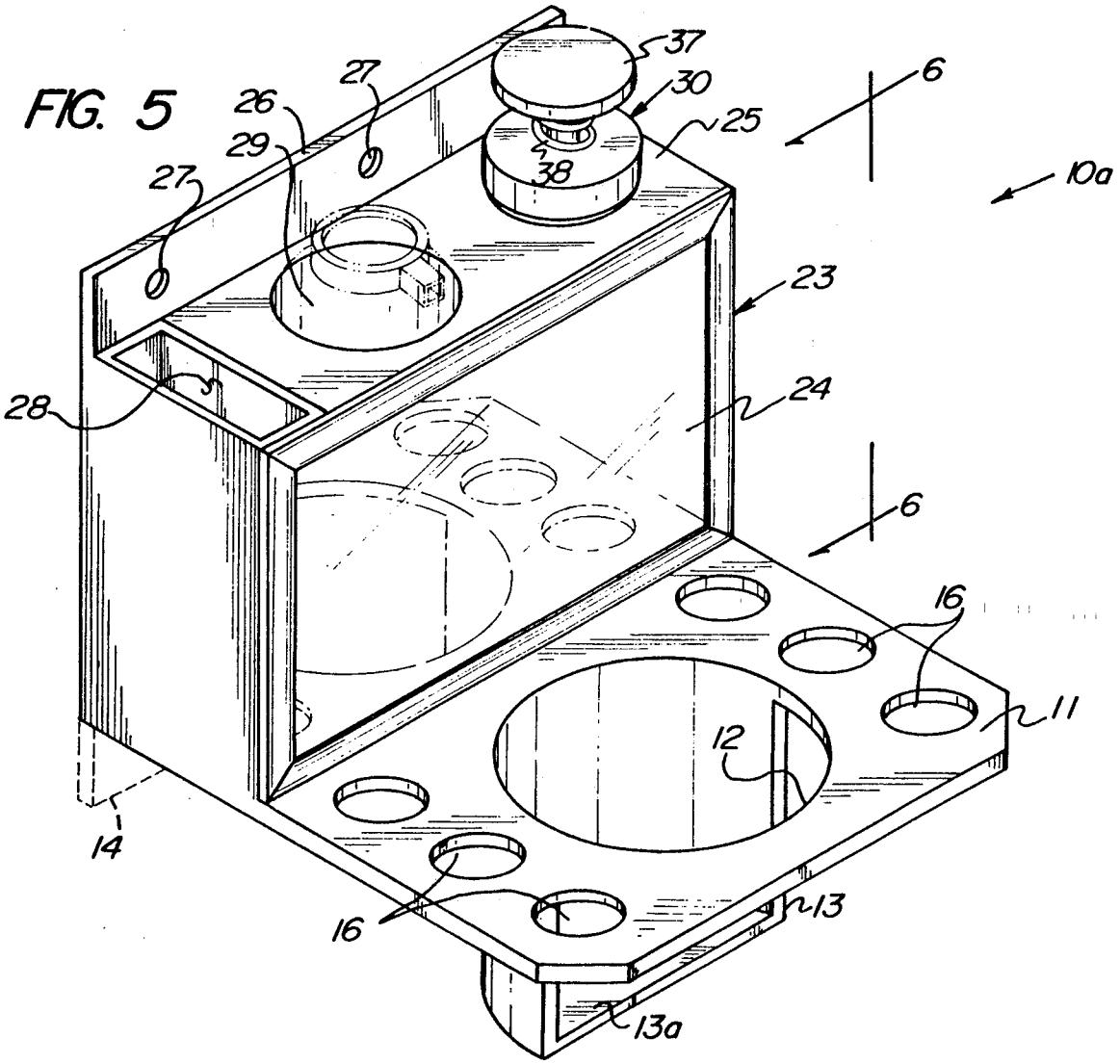
FIG. 5 is an isometric illustration of a modification of the invention.
Figure 6:
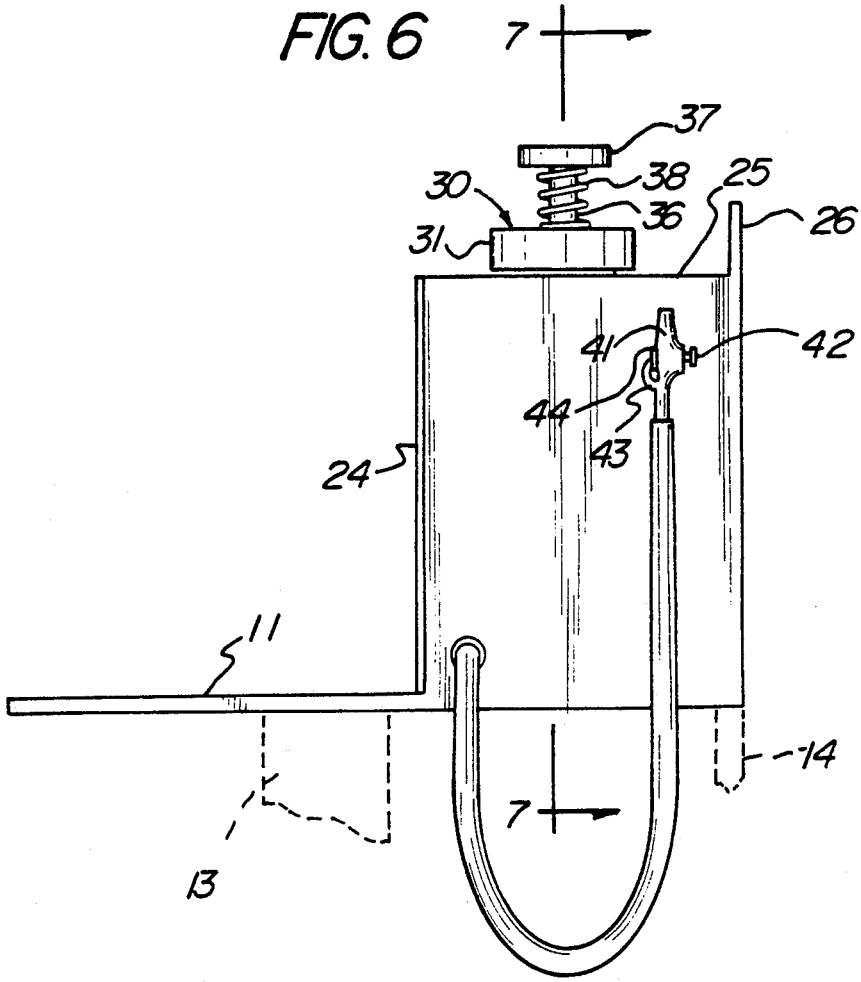
FIG. 6 is an orthographic view, taken along the lines 6—6 of FIG. 5 in the direction indicated by the arrows.
Figure 7:
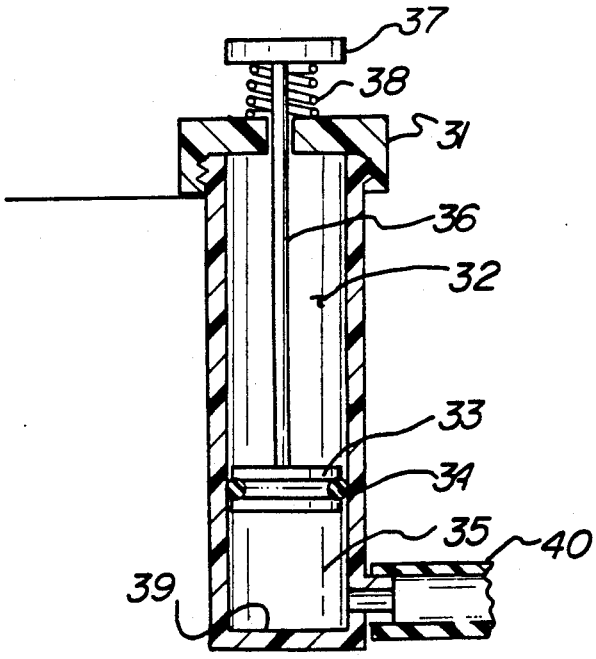
FIG. 7 is an orthographic view, taken along the lines 7—7 of FIG. 6 in the direction indicated by the arrows.

The apparatus 10*a*, as illustrated in the FIGS. 5–7, sets forth an apparatus as set forth in the FIG. 1, but to include in lieu of the magazine tube, a magazine housing 23 that includes a front wall mirror 24 for use by individuals for providing visual observation by the individual of a toothbrushing event, wherein the magazine housing 23 includes a housing top wall, with a rear flange 26 projecting upwardly relative to a ridge of the top wall, wherein the rear flange includes a rear flange bore 27 arranged for mounting of the organization in addition to the flange plate 14. A first rectilinear cavity 28 to receive a dental floss container is orthogonally directed downwardly relative to the magazine housing top wall 25. A second cavity 29 of a cylindrical configuration arranged to receive the toothpaste container therewithin is positioned adjacent the first cavity 28. A fluid dispenser 30 is positioned adjacent the second cavity 29 that includes a cap 31 overlying a well cavity 32. A piston 33, including a piston sealing ring 34 circumferentially about the piston 33, is slidably mounted within the well cavity 32 over a predetermined quantity of mouthwash fluid 35. A piston rod 36 orthogonally and coaxially mounted to the piston 33 projects upwardly through the well cavity 32 terminating in a piston rod handle 37 projecting above the cap 31. A spring 38 is captured between the handle 37 and the cap 31 to bias the piston in a raised orientation. The well cavity 32 includes a fluid well cavity floor 39, with a fluid outlet tube 40 in fluid communication with the well cavity 30 adjacent the floor 39. The outlet tube 40 terminates in a tube nozzle 41, with a valve 42 to control volume of fluid flow through the nozzle 41. A nozzle loop 43 is mounted to the nozzle for securement of the nozzle onto a hook 44 mounted to a side wall of the magazine housing 23 for convenience of storage of the outlet tube 40 and the associated nozzle 41.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toothpaste dispenser apparatus, comprising, a support plate, the support plate including a cup-receiving bore directed medially through the cup plate, wherein a semi-cylindrical flange is orthogonally mounted to a bottom surface of the support plate extending downwardly relative to the support plate coaxially aligned relative to the cup-receiving bore, the semi-cylindrical flange terminates in a flange floor oriented parallel to and spaced below the support plate to provide an abutment for a cup directed within the bore, and a rear flange plate orthogonally mounted to the bottom surface of the support plate, wherein the rear flange plate includes a plurality of flange plate mounting bores directed therethrough for securement of the rear flange plate to a support surface, and a plurality of toothbrush bores directed through the support plate adjacent the cup-receiving bore, and a magazine housing fixedly mounted to the support plate adjacent a rear edge of the support plate above the rear flange plate, wherein the magazine housing is arranged to receive a toothpaste container therewithin, and the magazine housing includes a front wall, a top wall, and a rear flange orthogonally mounted to the top wall extending upwardly thereof adjacent a rear edge of the top wall, wherein the rear flange includes rear flange bores to assist in securement of the rear flange to the support surface, and a mirror mounted within the front wall, and a first cavity directed through the top wall for reception of a dental floss container therewithin, and a second cylindrical cavity directed through the top wall to receive said toothpaste tube therewithin, and a fluid dispenser directed through the top wall interiorly of the magazine housing for dispensing of a mouthwash fluid, and the fluid dispenser includes a well cavity directed downwardly into the magazine housing below the top wall, and a cap selectively securable to an upper distal end of the well cavity, and a piston rod reciprocatably and coaxially directed through the cap, and the piston rod including a piston rod handle mounted to an upper distal end of the piston rod, and a piston mounted to a lower distal end of the piston rod within the wall cavity, and a piston sealing ring mounted in surrounding relationship relative to the piston in a circumferential orientation relative to the piston, and the well cavity including a well cavity floor, and an outlet tube in fluid communication with the well cavity directed into the well cavity through the magazine housing adjacent the well cavity floor.

2. An apparatus as set forth in claim 1, wherein the outlet tube is flexible and includes a nozzle mounted to a free distal end thereof spaced from the well cavity, and the nozzle including a nozzle valve, and a nozzle loop, and a hook mounted to the magazine housing wherein the nozzle loop is arranged for securement to the hook for storage of the nozzle and outlet tube.

* * * * *